US008348678B2

(12) United States Patent
Hardisty et al.

(10) Patent No.: US 8,348,678 B2
(45) Date of Patent: Jan. 8, 2013

(54) MAGNETIC CABLE CONNECTOR SYSTEMS

(75) Inventors: Jaime S. Hardisty, Albany, OR (US); Terry T. Babb, Portland, OR (US); Justin I. Wang, Beaverton, OR (US); Eric R. Irby, Beaverton, OR (US)

(73) Assignee: Automotive Industrial Marketing Corp., Portland, OR (US)

( * ) Notice: Subject to any disclaimer, the term of this patent is extended or adjusted under 35 U.S.C. 154(b) by 400 days.

(21) Appl. No.: 12/685,527

(22) Filed: Jan. 11, 2010

(65) Prior Publication Data

US 2011/0171837 A1 Jul. 14, 2011

(51) Int. Cl.
*H01R 11/30* (2006.01)

(52) U.S. Cl. ..... 439/39

(58) Field of Classification Search ..... 439/39, 439/348, 680, 38, 345, 677, 660
See application file for complete search history.

(56) References Cited

U.S. PATENT DOCUMENTS

| | | | |
|---|---|---|---|
| 2,170,287 | A | 8/1939 | Kinnebrew |
| 2,234,982 | A | 3/1941 | Ross |
| 2,762,991 | A | 9/1956 | Chlavin |
| 2,773,239 | A | 12/1956 | Parker |
| 3,144,527 | A | 8/1964 | Tolegian |
| 3,363,214 | A | 1/1968 | Wright |
| 3,431,428 | A | 3/1969 | Van Valer |
| 3,521,216 | A | 7/1970 | Tolegian |
| 3,651,447 | A | 3/1972 | Branco et al. |
| 3,670,287 | A | 6/1972 | Keto |
| 3,713,370 | A | 1/1973 | Prijn |
| 3,786,391 | A | 1/1974 | Mathauser |
| 3,808,577 | A | 4/1974 | Mathauser |
| 3,810,258 | A | 5/1974 | Mathauser |
| 3,868,160 | A | 2/1975 | Kersman |
| 4,211,456 | A | 7/1980 | Sears |
| 4,317,969 | A | 3/1982 | Riegler et al. |
| 4,484,761 | A | 11/1984 | Knabel et al. |

(Continued)

FOREIGN PATENT DOCUMENTS

DE 10333403 A1 9/2004

(Continued)

OTHER PUBLICATIONS

Julie Vallese, "Break-Away cord aims to make deep fryers safer," Online New Article, Jul. 4, 2001, 2 pages, http://archives.cnn.com/2001/US/07/03/deep.fryers/.

(Continued)

*Primary Examiner* — Felix O Figueroa
(74) *Attorney, Agent, or Firm* — Schwabe, Williamson & Wyatt

(57) ABSTRACT

Cable assemblies and connector systems that include magnetic elements are disclosed. The cable assemblies may include first and second cables. A first plurality of magnetic elements may be arranged around the first cable proximate a first end, while a second plurality of magnetic elements may be arranged around the second cable proximate a second end. Magnetic forces between respective ones of the first and second pluralities of magnetic elements may tend to retain the respective first and second ends of the first and second cables proximate one another. The connector systems may include mating retainers, each of which may include a plurality of magnetic elements. Magnetic forces between respective ones of the pluralities of magnetic elements may tend to retain the mating retainers proximate one another. In some examples, the mating retainers may include guiding elements, which may be configured to orient the mating retainers.

18 Claims, 2 Drawing Sheets

U.S. PATENT DOCUMENTS

| | | | |
|---|---|---|---|
| 4,494,816 | A | 1/1985 | Tamburro |
| 4,588,241 | A | 5/1986 | Ardezzone |
| 4,669,791 | A | 6/1987 | Savill |
| 4,690,495 | A | 9/1987 | Giannini |
| 4,767,337 | A | 8/1988 | Kawasaki et al. |
| 4,772,212 | A | 9/1988 | Sotolongo |
| 4,776,406 | A | 10/1988 | Wanner |
| 4,810,202 | A | 3/1989 | Nodfelt |
| 4,844,582 | A | 7/1989 | Giannini |
| 4,867,704 | A | 9/1989 | Standke |
| 4,874,316 | A | 10/1989 | Kamon et al. |
| 5,004,425 | A | 4/1991 | Hee |
| 5,315,064 | A | 5/1994 | Andrews |
| 5,382,167 | A | 1/1995 | Janson, Jr. |
| 5,382,476 | A | 1/1995 | Weiser et al. |
| 5,401,175 | A | 3/1995 | Guimond et al. |
| 5,623,122 | A | 4/1997 | Anderson et al. |
| 5,812,356 | A | 9/1998 | O'Connor |
| 5,816,825 | A | 10/1998 | Sekimori et al. |
| 5,829,987 | A | 11/1998 | Fritsch et al. |
| 5,921,783 | A | 7/1999 | Fritsch et al. |
| 5,941,729 | A | 8/1999 | Sri-Jayantha |
| 5,954,520 | A | 9/1999 | Schmidt |
| 5,971,810 | A | 10/1999 | Taylor |
| 6,030,229 | A | 2/2000 | Tsutsui |
| 6,042,385 | A | 3/2000 | Watanabe et al. |
| 6,183,264 | B1 | 2/2001 | Harsanyi |
| 6,217,339 | B1 | 4/2001 | Tsubata |
| 6,219,267 | B1 | 4/2001 | Andres |
| 6,250,931 | B1 | 6/2001 | Mendelson |
| 6,267,602 | B1 | 7/2001 | Mendelson et al. |
| 6,340,302 | B1 | 1/2002 | Ladd |
| 6,464,509 | B1 | 10/2002 | Emberty et al. |
| 6,478,614 | B1 | 11/2002 | De'Longhi |
| 6,527,570 | B1 | 3/2003 | Hartman et al. |
| 6,528,746 | B2 | 3/2003 | DeWitt et al. |
| 6,561,815 | B1 | 5/2003 | Schmidt |
| 6,604,882 | B2 | 8/2003 | Gordon et al. |
| 6,607,391 | B2 | 8/2003 | Mendelson et al. |
| 6,623,276 | B2 | 9/2003 | Ferrerfabrega et al. |
| 6,727,477 | B1 | 4/2004 | Li-Chen |
| 6,821,126 | B2 | 11/2004 | Neidlein |
| 6,884,083 | B2 | 4/2005 | Shepherd |
| 6,966,781 | B1 | 11/2005 | Bullinger et al. |
| 6,976,882 | B2 | 12/2005 | Kernan |
| 6,988,897 | B2 | 1/2006 | Belongia et al. |
| 7,032,288 | B2 | 4/2006 | Ladd |
| 7,066,739 | B2 | 6/2006 | McLeish |
| 7,097,461 | B2 * | 8/2006 | Neidlein ..... 439/39 |
| 7,112,103 | B2 | 9/2006 | Zhang et al. |
| 7,264,479 | B1 | 9/2007 | Lee |
| 7,277,013 | B2 | 10/2007 | Yen |
| 7,311,526 | B2 | 12/2007 | Rohrbach et al. |
| 7,334,433 | B1 | 2/2008 | Fuhrman et al. |
| 7,351,066 | B2 | 4/2008 | DiFonzo et al. |
| 7,517,222 | B2 | 4/2009 | Rohrbach et al. |
| 7,625,212 | B2 | 12/2009 | Du |
| 2003/0148643 | A1 | 8/2003 | Yoji |
| 2004/0133065 | A1 | 7/2004 | Easter et al. |
| 2004/0184295 | A1 | 9/2004 | Robertson et al. |
| 2004/0209489 | A1 | 10/2004 | Clapper |
| 2005/0164562 | A1 * | 7/2005 | Lee et al. ..... 439/680 |
| 2005/0208783 | A1 | 9/2005 | Suzuki et al. |
| 2005/0255716 | A1 | 11/2005 | Tanaka et al. |
| 2005/0255718 | A1 | 11/2005 | McLeish |
| 2006/0051981 | A1 | 3/2006 | Neidlein et al. |
| 2006/0073722 | A1 | 4/2006 | Allan |
| 2009/0239392 | A1 * | 9/2009 | Sumitomo et al. ..... 439/39 |
| 2010/0144164 | A1 * | 6/2010 | Wang et al. ..... 439/39 |

FOREIGN PATENT DOCUMENTS

| | | | |
|---|---|---|---|
| GB | 2360637 | A | 9/2001 |
| JP | 03059973 | A | 3/1991 |
| JP | 03059973 | U | 9/1991 |
| JP | 05335051 | | 12/1993 |
| JP | 2002056929 | | 2/2002 |

OTHER PUBLICATIONS

"MagSafe," Online Encyclopedia Entry, Dec. 18, 2009, 2 pages, http://en.wikipedia.org/wiki/MagSafe.

"File: MagSafe1.jpg," Online Encyclopedia Entry, Dec. 18, 2009, 3 pages, http://en.wikipedia.org/wiki/File:MagSafe1.jpg.

* cited by examiner 20
22
24
30
32
34
36
38
40
46
48
52
54
56
60
66
68
70
72
76
78
92
94
98
100
106
108,114
110,112
116
118
4
5

MAGNETIC CABLE CONNECTOR SYSTEMS

FIELD OF THE DISCLOSURE

The present disclosure relates to cable connector systems that include magnetic elements.

BACKGROUND OF THE DISCLOSURE

Examples of electrical connectors and/or plugs that include magnetic elements are disclosed in U.S. Pat. Nos. 2,170,287; 3,363,214; 3,431,428; 3,521,216; 3,808,577; 4,844,582; 4,874,316; 5,401,175; 5,812,356; 5,816,825; 5,941,729; 5,954,520; 6,183,264; 6,250,931; 6,267,602; 6,478,614; 6,527,570; 6,561,815; 6,607,391; 6,623,276; 6,727,477; 6,988,897; 7,066,739; 7,264,479; 7,311,526; 7,351,066 and 7,517,222; in U.S. Patent Application Publication Nos. 2004/0209489; 2005/0208783 and 2005/0255718; in German Patent No. DE10333403A1; and in Japanese Patent Nos. JP05335051A and JP2002056929A. Examples of magnetic connectors and/or couplings are disclosed in U.S. Pat. Nos. 4,484,761; 4,776,406; 7,277,013 and 7,334,433. Examples of cable breakaway connection devices are disclosed in U.S. Pat. Nos. 5,315,064 and 5,623,122. The disclosures of these and all other publications referenced herein are incorporated by reference in their entirety for all purposes.

SUMMARY OF THE DISCLOSURE

In some examples, a cable assembly may include first and second cables and first and second retainers. The first cable may include a first end. A first electrical contact and a first connecting portion may be disposed proximate the first end. The second cable may include a second end. A second electrical contact and a second connecting portion may be disposed proximate the second end. Engagement between the first and second connecting portions may retain the first and second electrical contacts in electrical contact with each other. The first retainer may be disposed proximate the first end of the first cable and may include a first plurality of magnetic elements arranged around the first cable. The second retainer may be disposed proximate the second end of the second cable and may include a second plurality of magnetic elements arranged around the second cable. Magnetic forces between respective ones of the first and second pluralities of magnetic elements may tend to retain the first and second retainers proximate one another.

In some examples, a cable assembly may include first and second cables. The first cable may include a first end, and a first electrical contact may be disposed proximate the first end. The second cable may include a second end, and a second electrical contact may be disposed proximate the second end. One of the first and second electrical contacts may be configured to resist separation therefrom of the other of the first and second electrical contacts such as when the first and second electrical contacts are in electrical contact with each other. A first plurality of magnetic elements may be disposed in a first arcuate arrangement around the first end of the first cable. A second plurality of magnetic elements may be disposed in a second arcuate arrangement around the second end of the second cable. The second arcuate arrangement may correspond to the first arcuate arrangement. Magnetic forces between respective ones of the first and second pluralities of magnetic elements may tend to retain the first and second ends of the first and second cables proximate one another with the first and second electrical contacts in electrical contact with each other.

In some examples, a connector system for securing two cables may include a retainer and a mating retainer. The retainer may include a first cable receiving region that defines a first axis, a first plurality of magnetic elements, which may be disposed around the first cable receiving region along a first arcuate path, and an asymmetric guiding element. The mating retainer may include a second cable receiving region that defines a second axis. The mating retainer may include a second plurality of magnetic elements, which may be disposed around the second cable receiving region along a second arcuate path, which may correspond to the first arcuate path. The mating retainer may include a complementary guiding element, which may be configured to engage the asymmetric guiding element and orient the retainer and mating retainer with the first and second axes substantially aligned. The retainer and the mating retainer may be configured such that magnetic forces between respective ones of the first and second pluralities of magnetic elements may tend to retain the first and second retainers proximate one another with the first and second cable receiving regions substantially aligned with one another.

DETAILED DESCRIPTION OF THE DISCLOSURE

Figures 1, 3, 4:
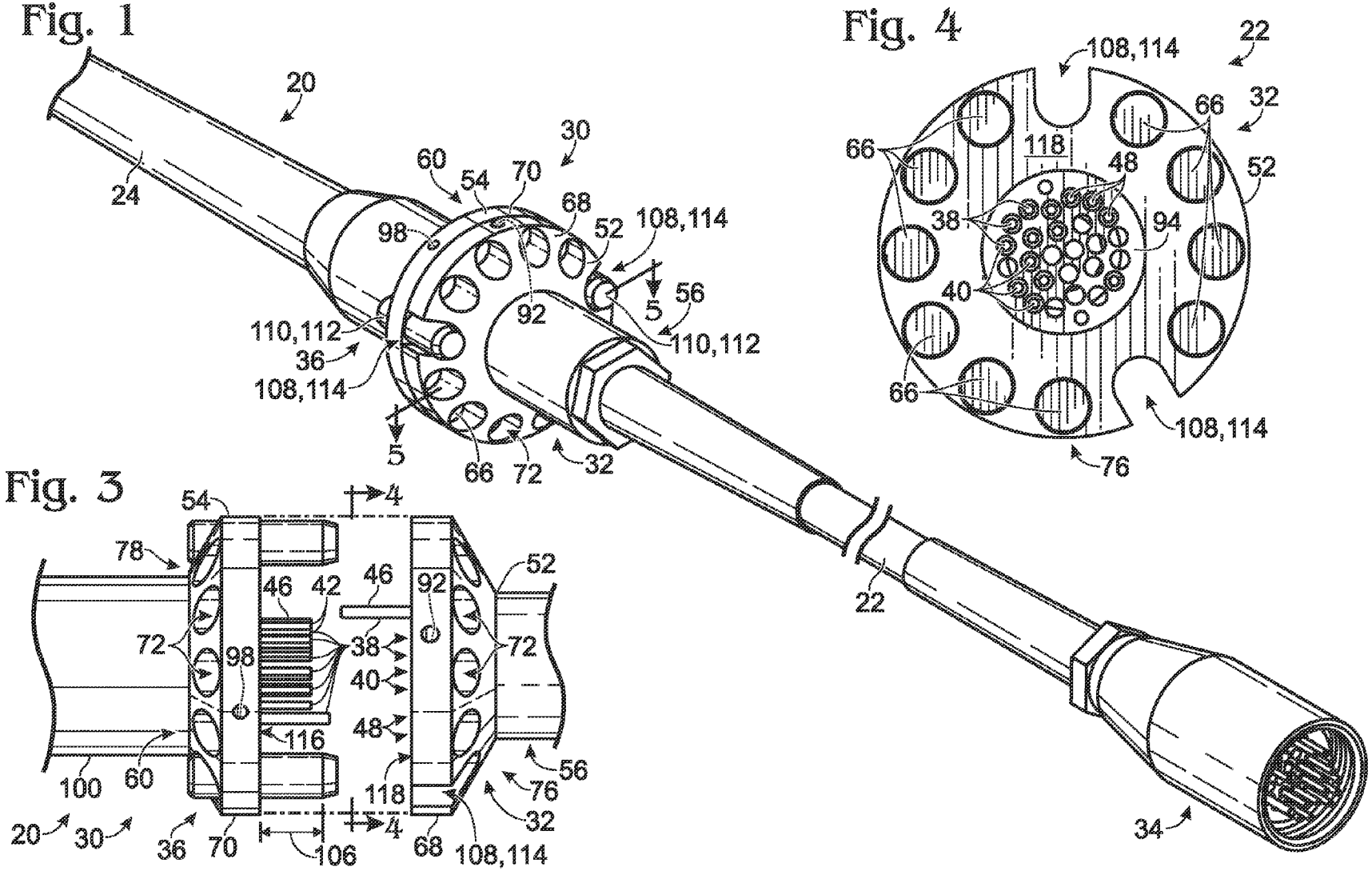
FIG. 1 is a perspective view of a nonexclusive illustrative example of a cable assembly that includes a nonexclusive illustrative example of a connector system, with the cables shown connected.
FIG. 3 is top view of the cable assembly of FIG. 1 with the cables shown disconnected.
FIG. 4 is a detail view of the cable assembly of FIG. 1, taken generally along line 4-4 in FIG. 3.

A nonexclusive illustrative example of a cable assembly is shown generally at 20 in FIGS. 1-5. The cable assembly may include first and second cables 22, 24 and a connector system 30. Unless otherwise specified, cable assembly 20 and/or connector system 30 may, but are not required to, contain at least one of the structures, components, functionalities, concepts, and/or variations described, illustrated, and/or incorporated herein.

The first cable 22 may extend from a first end 32 to a second end 34, and the second cable 24 may extend from a first end (not shown) to a second end 36. The first and second cables may be configured as electrical and/or control cables. As such, each of the first and second cables may include one or more electrical contacts 38 disposed proximate or on the first and second ends of the cables. For example, one or more first electrical contacts 40 may be disposed proximate, or even on, the first end 32 of the first cable 22 and one or more second electrical contact 42 may be disposed proximate, or even on, the second end 36 of the second cable 24. The electrical contacts proximate or on the ends of the cables may be of any suitable configuration, including complementary male 46 and female 48 contacts, which may be arranged proximate or on either or both ends of the cables in any suitable configuration.

Figure 2:
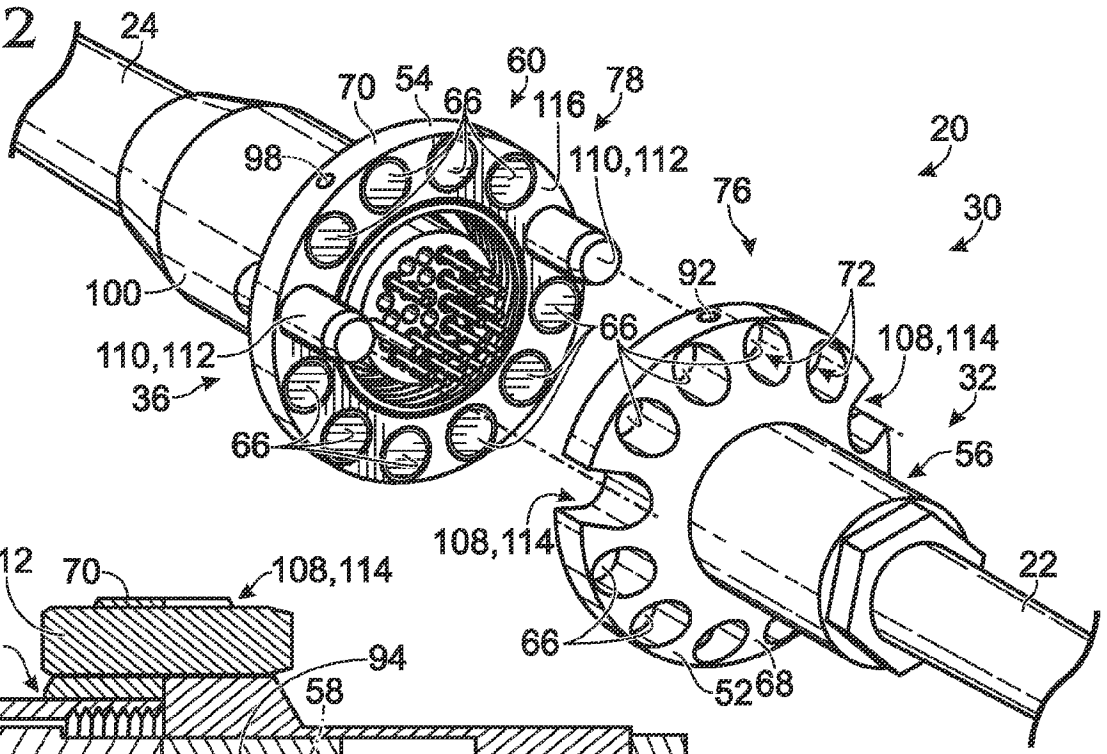
FIG. 2 is a perspective view of a portion of the cable assembly of FIG. 1 with the cables shown disconnected.

In some examples, one of the first and second electrical contacts may be configured to resist separation therefrom of the other of the first and second electrical contacts when the first and second electrical contacts are in electrical contact with each other. For example, as shown in FIGS. 2-4, at least some of the first electrical contacts 40 may be female receptacles and/or sockets configured to receive the correspondingly configured male projections and/or plugs that form at least some of the second electrical contacts 42. In such an example, the first electrical contacts 40 may configured to retain the second electrical contacts 42 such that the second electrical contacts remain in electrical contact with the first electrical contacts.

In some examples, at least some of the ends of the cables may include a connecting portion or feature that may tend to retain the electrical contacts of the cables in electrical contact with each other. For example, the ends of the cables may include suitable threaded, frictional, and/or cammed connecters, or the like, which may tend to maintain electrical contact between the corresponding electrical contacts of the cables. In the example shown in FIGS. 2-4, the first electrical contact 40 may at least partially form a first connecting portion disposed proximate, or even on, the first end 32 of the first cable 22 while the second electrical contact 42 may at least partially form a second connecting portion disposed proximate, or even on, the second end 36 of the second cable 24. In such an example, engagement between the first and second electrical contacts may tend to retain the first and second electrical contacts in electrical contact with each other, such as where the female contact 48 tends to resist removal of the male contact 46 once the male contact has been inserted into the socket of the female contact.

Figure 5:
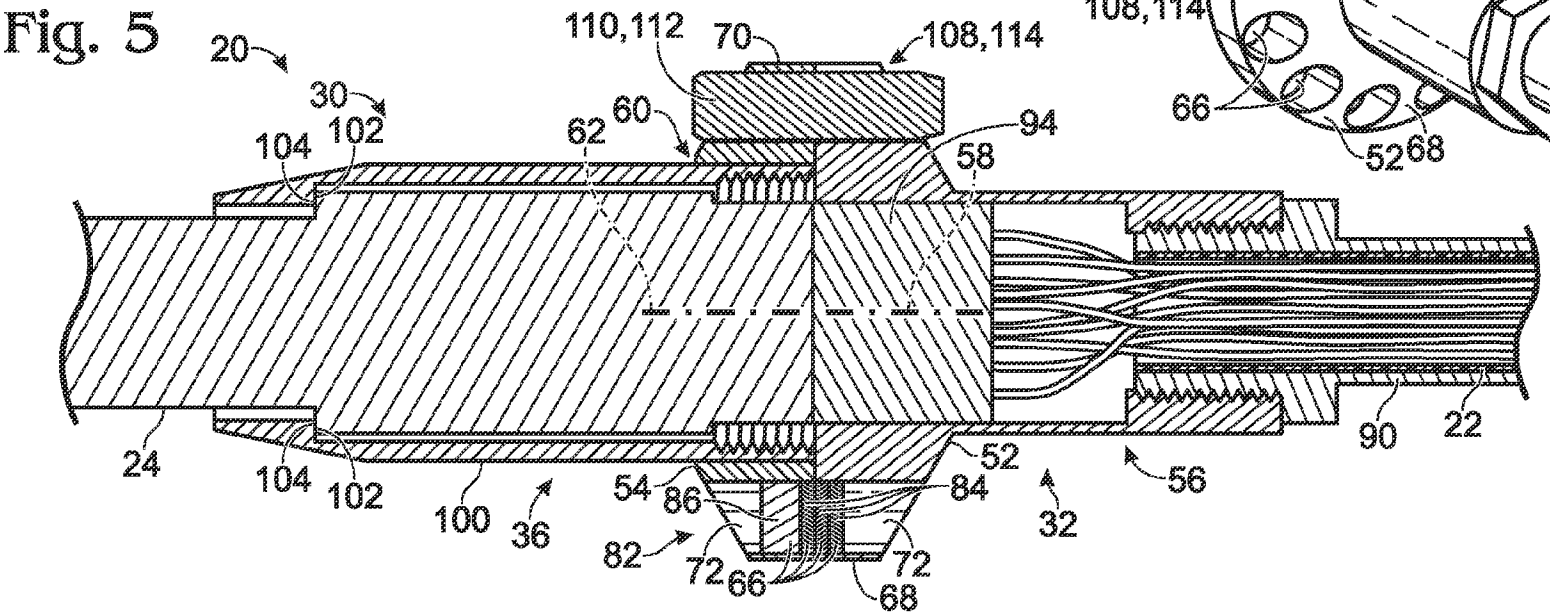
FIG. 5 is a section view of the cable assembly of FIG. 1, taken generally along line 5-5 in FIG. 1, with the details of the termination of the various individual wires from the cables shown schematically and/or omitted.

The connector system 30 may include first and second retainers 52, 54. The first retainer 52 may be disposed proximate, or even on, the first end 32 of the first cable 22 and may include a first cable receiving region 56 that defines a first axis 58. The second or mating retainer 54 may be disposed proximate, or even on, the second end 36 of the second cable 24 and may include a second cable receiving region 60 that defines a second axis 62. As shown in FIGS. 1 and 5, the first end 32 of the first cable 22 may be received within the first cable receiving region 56, while the second end 36 of the second cable 24 may be received within the second cable receiving region 60.

A plurality of magnetic elements 66 may be disposed proximate and/or around respective ones of the first end 32 of the first cable 22 and the second end 36 of the second cable 24. For example, as shown in FIGS. 1-5, each of the first and second retainers 52, 54 may include a flange 68, 70 having a plurality of openings, such as holes 72, in which the plurality of magnetic elements 66 may be disposed. Each of the magnetic elements may be mounted and/or secured within a respective one of the holes 72 using any suitable method, such as adhesively bonding a slip- or otherwise-fitted magnetic element, over-molding, swaging, staking, or even frictional- and/or interference-fitting of the magnetic element. Although the magnetic elements are shown as discrete components within openings on, or at least partially through, the first and second retainers, it should be understood that the magnetic elements may be mounted to, on, or even within the first and second retainers in any suitable fashion. For example, the retainers may be cast, molded or otherwise formed around the magnetic elements and/or discrete portions of the retainer could be magnetized.

The magnetic elements 66 may include any suitable combination of permanent magnets, electromagnets and/or ferromagnetic materials, which ferromagnetic materials may or may not be permanent magnets. For example, at least some of the first and second pluralities of magnetic elements may comprise permanent magnets, while at least some of the first and second pluralities of magnetic elements may comprise ferromagnetic material. In some examples, at least some of the first plurality of magnetic elements on the first retainer 52 may comprise permanent magnets, while at least some of the second plurality of magnetic elements on the second retainer 54 may comprise a ferromagnetic material. A nonexclusive illustrative example of a suitable permanent magnet would be the samarium-cobalt disk magnets sold by McMaster-Carr Supply Company of Robbinsville, N.J. as part number 5716K73. However, it should be understood that other types, shapes and/or configurations of permanent magnets, including other types, shapes and/or configurations of rare earth magnets may be used.

As shown in FIGS. 2 and 4, the first retainer 52 may include a first plurality of the magnetic elements 66, which may be arranged in a first pattern 76, while the second retainer 54 may include a second plurality of the magnetic elements 66, which may be arranged in a second pattern 78, which second pattern may correspond to, or may even be substantially the same as, the first pattern. As shown in FIG. 4, the first pattern 76 may involve the first plurality of magnetic elements 66 being disposed on the first retainer 52 along one or more arcuate paths around the first cable receiving region 56 and/or around the first end 32 of the first cable 22. As shown in FIG. 2, the second pattern 78 may involve the second plurality of magnetic elements 66 being disposed on the second retainer 54 along one or more arcuate paths around the second cable receiving region 60 and/or around the second end 36 of the second cable 24. The arcuate paths in which the first and second pluralities of magnetic elements are disposed on the first and second retainers 52, 54 may correspond to each other. In some examples, the arcuate paths of the magnetic elements on the first and second retainers 52, 54 may be substantially circular and/or include one or more circular arcs.

As used herein, correspondence between the first and second patterns 76, 78, and/or between the arcuate paths, may mean that each of the first plurality of magnetic elements disposed on the first retainer 52 may be sufficiently aligned with a corresponding one of the second plurality of magnetic elements disposed on the second retainer 54 such that the two magnetic elements may be drawn and/or held together by way of the magnetic forces therebetween. Thus, even though corresponding first and second patterns and/or arcuate paths may only be sufficiently similar, some examples of corresponding first and second patterns and/or arcuate paths may be substantially identical.

The first and second patterns 76, 78 may include any suitable number of magnetic elements 66. For example, as shown in FIGS. 1-5, the first and second patterns 76, 78 may each include ten (10) magnetic elements 66, which are arranged in a generally circular pattern having a substantially constant radius. However, it should be understood that either or both of the first and second patterns 76, 78 may include a greater or lesser number of magnetic elements 66. The number of magnetic elements included in a particular first or second pattern may be a function of such factors as the size of the connected cables, the size of the magnetic elements, the pull-strength of the magnetic elements, and/or the magnetic forces desired between the first and second retainers. Furthermore, in some examples, one of the first and second patterns 76, 78 may include a different number of magnetic elements 66 than are included in the other of the first and second patterns 76, 78.

The first and second retainers 52, 54 may be configured such that magnetic forces between respective ones of the first and second pluralities of the magnetic elements 66 may tend to retain the first and second retainers proximate one another with the first and second cable receiving regions 56, 60 substantially aligned with each other. Retaining the first and second retainers 52, 54 proximate one another with the first and second cable receiving regions 56, 60 substantially aligned may tend to retain the first end 32 of the first cable 22 proximate the second end 36 of the second cable 24, which may tend to retain the first and second electrical contacts 40, 42 in electrical contact with each other.

The magnetic forces between the first and second retainers 52, 54 due to the first and second pluralities of magnetic elements may be selected and/or adjusted to achieve a particular level of retaining force between the first and second retainers 52, 54. For example, it may be desirable to provide a suitably high connecting force between the first and second cables, which may tend to reduce and/or impede inadvertently disconnecting the cables. In some examples, it may be desirable that the first and second cables separate when the cables are subjected to an excessive load, which may tend to protect from damage the cables themselves and/or devices to which either or both of the cables may be connected. Nonexclusive illustrative examples of separation forces that may be necessary to overcome the magnetic forces between the first and second retainers may include about 10, 15, 20, 25, 30, 35, 40, 45, 50, 55, 60, 65, 70, 75, or even 80 or more pounds of force. It should be understood that these numbers are illustrative examples and other forces and/or ranges of forces, both larger and smaller, are possible.

The magnetic forces may be selected and/or adjusted by using suitable combinations of magnetic elements on the first and second retainers 52, 54. These combinations may be consistent at each location on a particular retainer, or the combinations may vary from location to location on a particular retainer, with some corresponding pairs of magnetic elements having relatively higher or lower magnetic forces therebetween than do other corresponding pairs. As used herein, a corresponding pair of magnetic elements would include a magnetic element on one of the first and second retainers 52, 54 and the magnetic element or elements on the other one of the first and second retainers 52, 54 that is/are in alignment with the magnetic element on the one of the first and second retainers 52, 54 when the first and second retainers 52, 54 are proximate one another with the first and second cable receiving regions 56, 60 substantially aligned.

A nonexclusive illustrative example of a particular corresponding pair 82 of magnetic elements is shown in FIG. 5. As shown in FIG. 5, the corresponding pair 82 includes two permanent magnets 84 disposed within, and mounted to, one of the holes 72 through the flange 68 of the first retainer 52 and one permanent magnet 84 and one piece 86 of a ferromagnetic material disposed within, and mounted to, one of the holes 72 through the flange 70 of the second retainer 54. In some examples, the piece 86 of a ferromagnetic material may be a magnetic steel, which may be highly magnetically permeable. It should be understood that other combinations of permanent magnets and/or ferromagnetic materials may be used to achieve a desired level of magnetic force, and are within the scope of this disclosure. Nonexclusive illustrative examples of such combinations may include one or more permanent magnets opposing one or more permanent magnets, one or more permanent magnets opposing one or more pieces of ferromagnetic material, one or more permanent magnets opposing one or more permanent magnets combined with one or more pieces of ferromagnetic material, one or more permanent magnets combined with one or more pieces of ferromagnetic material opposing one or more permanent magnets combined with one or more pieces of ferromagnetic material.

In examples where the components of corresponding pairs of magnetic elements differ between the first and second retainers, such as with the example shown in FIG. 5, it should be understood that each of the corresponding pairs need not be consistently oriented. For example, some of the corresponding pairs may have one or more permanent magnets on the first retainer and a piece of a ferromagnetic material on the second retainer, while other ones of the corresponding pairs may have a piece of a ferromagnetic material on the first retainer and one or more permanent magnets on the second retainer. However, in some examples, all of the corresponding pairs may have substantially identical arrangements of their constituent parts relative to the first and second retainers.

In some examples, the magnetic senses of the corresponding pairs of magnetic elements may be consistent at each location. In particular, each corresponding pair of magnetic elements may have an attractive magnetic force with the north and south poles consistently oriented with respect to the first and second retainers 52, 54. In other examples, the polarity of the magnetic forces may vary amongst and/or between the pairs of magnetic elements. In examples where the variation is asymmetrical, the first and second retainers 52, 54 might be effectively magnetically-keyed such that the first and second retainers might only be connectable when properly aligned.

The first and second retainers 52, 54 may be attached to respective ones of the first and second cables 22, 24 in any suitable manner. By way of example, the connector system 30 may thus be provided as part of a preconfigured cable set that includes the first and second retainers pre-mounted to a pair of cables; as a combination of a cable, which includes the first retainer 52 mounted thereon, and a corresponding second retainer 54 for mounting to an existing cable; and/or as a pair of retainers configured for use with a pair of pre-existing and/or standard cables.

For example, at least one of the retainers may be fixed and/or rigidly mounted to one of the cables, as is the case for the first retainer 52 shown in FIGS. 1-5. The first retainer 52 shown in FIGS. 1-5 is attached the to the first cable 22 with a strain relief 90, and is secured by way of a set screw 92 to a molded insert 94 that houses the electrical contacts at the first end 32 of the first cable 22. In some examples, at least one of the retainers may be configured and/or mounted to one of the cables in such a manner that the retainer may be rotated and/or axially moved relative to the cable. For example, the second retainer 54 shown in FIGS. 1-5 is attached by way of a set screw 98 to a connector 100 mounted on the second cable 24, with the connector 100 being freely rotatable and axially movable relative to the second cable 24. In such an example, the magnetic forces that tend to retain the first and second retainers together may be transmitted from the second retainer 54 to the second cable 24 by way of a protrusion or step 102 on the second cable that engages a corresponding step or lip 104 within the connector 100 to which the second retainer 54 is mounted. As the second retainer 54 and connector 100 may be moved axially along the second cable 24, and away from the first retainer 52 on the first cable 22, the first and second retainers 52, 54 shown in FIGS. 1-5 may be separated from each other without disconnecting and/or interrupting the electrical contact between the electrical contacts of the first and second cables.

In some examples, the connector system 30 may be configured to maintain alignment between the first end 32 of the first cable 22 and the second end 36 of the second cable 24 as the first and second cables are being separated. For example, the first and second retainers 52, 54 may be configured to maintain alignment between the first end 32 of the first cable 22 and the second end 36 of the second cable 24 until the electrical contacts of the two cables are at least substantially completely separated, which may reduce and/or prevent potential damage to the electrical contacts. Thus, as suggested in FIG. 3, the connector system 30 may be configured to generally maintain substantial alignment between the cables until the first and second retainers 52, 54 are separated by at least a predetermined distance 106, which may be sufficient to maintain alignment between the cables until the male contacts 46 are sufficiently, or even substantially fully, disengaged from the female contacts 48. The male contacts may be sufficiently disengaged from the female contacts when transverse forces and/or movement between the respective ends of the first and second cables tends to cause the contacts to disengage from one another rather then bending or otherwise become damaged due to misalignments between the respective ends of the first and second cables. Accordingly, the predetermined distance 106 illustrated in FIG. 3 should be understand as being an illustrative example, and a suitable predetermined distance may be greater than or less than that illustrated in FIG. 3.

As shown in the connector system illustrated in FIGS. 1-5, the first retainer 52 may include at least one guiding or guide element 108, while the second retainer 54 may include at least one corresponding or complementary guiding or guide element 110. The guide elements 108 may be configured to receive and/or engage the complementary guide elements 110 to orient the first and second retainers 52, 54 with the first and second axes 58, 62 substantially aligned such that the first end 32 of the first cable 22 may be aligned with the second end 36 of the second cable 24. In the illustrated example, the at least one complementary guide element 110 includes a pair of guide pins 112, which are mounted on the second retainer 54 and substantially aligned with the second axis 62. The illustrated at least one guide element 108 includes a pair of corresponding openings 114 on the first retainer 52, which are substantially aligned with the first axis 58 and configured to receive and/or engage the guide pins 112. Although shown with two pins 112 and two openings 114, it should be understood that a single pin and corresponding opening may be used, as could three or more pins and corresponding openings. Furthermore, in some examples, one of the first and second retainers may include at least one pin and at least one opening, with the other of the first and second retainers including at least one corresponding opening and at least one corresponding pin.

When the guide elements 108 and complementary guide elements 110 comprise pins and openings, as shown in FIGS. 1-5, the openings 114 may be configured to receive the pins 112 with a slip fit. Furthermore, the guide pins 112 may project sufficiently far from the mating face of the retainer on which they are disposed that the pins 112 may be configured to remain engaged with the openings 114, and orient the first and second retainers 52, 54 with the first and second axes 58, 62 substantially aligned, when the mating faces 118, 116 of the first and second retainers 52, 54 are separated by less than the predetermined distance 106.

In some examples, the guide elements 108 and the complementary guide elements 110 may be asymmetrically disposed on the first and second retainers 52, 54. For example, the arrangements of guide elements 108 and complementary guide elements 110 may lack radial symmetry with respect to the first and second axes 58, 62. Such an asymmetric arrangement may effectively "key" the first and second retainers such that they may only be connected in a single, or limited number of, orientations. For example, the first retainer may include a single guide element, while the second retainer may include a single complementary guide element. Or, the first retainer may include plural guide element asymmetrically disposed thereon, while the second retainer may include plural complementary guide elements asymmetrically disposed thereon. As shown in the example of FIGS. 1-5, a pair of pins 112 are asymmetrically disposed on the second retainer 54, while a pair of openings 114 are correspondingly asymmetrically disposed on the first retainer 52.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A cable assembly, comprising:

a first cable having a first end, a first electrical contact disposed proximate the first end, and a first connecting portion disposed proximate the first end;

a second cable having a second end, a second electrical contact disposed proximate the second end, and a second connecting portion disposed proximate the second end, wherein engagement between the first and second connecting portions retains the first and second electrical contacts in electrical contact with each other;

a first retainer disposed proximate the first end of the first cable and including a first plurality of magnetic elements arranged around the first cable; and a second retainer disposed proximate the second end of the second cable and including a second plurality of magnetic elements arranged around the second cable, wherein magnetic forces between respective ones of the first and second pluralities of magnetic elements tend to retain the first and second retainers proximate one another; and wherein one of the first and second retainers is configured for rotation relative to a respective one of the first and second cables, and the other one of the first and second retainers is fixed relative to the respective other one of the first and second cables.

2. The cable assembly of claim 1, wherein one of the first and second electrical contacts is configured to retain the other of the first and second electrical contacts in electrical contact with the one of the first and second electrical contacts.

3. The cable assembly of claim 1, wherein the first connecting portion comprises the first electrical contact, the second connecting portion comprises the second electrical contact, and engagement between the first and second electrical contacts tends to retain the first and second electrical contacts in electrical contact with each other.

4. The cable assembly of claim 1, wherein the one of the first and second retainers is configured to permit separation of the first and second retainers without interrupting the electrical contact between the first and second electrical contacts.

5. The cable assembly of claim 1, wherein the first plurality of magnetic elements are arranged in a first pattern around the first cable, the second plurality of magnetic elements are arranged in a second pattern around the second cable, and the first and second patterns are substantially circular.

6. The cable assembly of claim 1, wherein at least some of the first plurality of magnetic elements comprise permanent magnets.

7. The cable assembly of claim 6, wherein at least some of the second plurality of magnetic elements comprise a ferromagnetic material.

8. The cable assembly of claim 1, wherein one of the first and second retainers includes a guide pin and the other of the first and second retainers includes an opening configured to engage the guide pin.

9. A cable assembly, comprising:

a first cable having a first end and a first electrical contact disposed proximate the first end;

a second cable having a second end and a second electrical contact disposed proximate the second end, wherein one of the first and second electrical contacts is configured to resist separation therefrom of the other of the first and second electrical contacts when the first and second electrical contacts are in electrical contact with each other;

a first plurality of magnetic elements disposed in a first arcuate arrangement around the first end of the first cable; and a second plurality of magnetic elements disposed in a second arcuate arrangement around the second end of the second cable, wherein the second arcuate arrangement corresponds to the first arcuate arrangement, and magnetic forces between respective ones of the first and second pluralities of magnetic elements tend to retain the first and second ends of the first and second cables proximate one another with the first and second electrical contacts in electrical contact with each other; and wherein one of the first and second retainers is configured for rotation relative to a respective one of the first and second cables, and the other one of the first and second retainers is fixed relative to the respective other one of the first and second cables.

10. The cable assembly of claim 9, wherein at least some of the first plurality of magnetic elements comprise permanent magnets, and at least some of the second plurality of magnetic elements comprise a ferromagnetic material.

11. The cable assembly of claim 9, comprising:

a first retainer disposed proximate the first end of the first cable, wherein the first plurality of magnetic elements are disposed on the first retainer; and a second retainer disposed proximate and configured for rotation about the second end of the second cable, wherein the second plurality of magnetic elements are disposed on the second retainer.

12. The cable assembly of claim 11, wherein one of the first and second retainers includes at least two guide elements and the other of the first and second retainers includes at least two openings configured to receive the guide elements, and the guide elements are asymmetrically disposed on the one of the first and second retainers.

13. A connector system for securing two cables, comprising:

a retainer having a first cable receiving region that defines a first axis, wherein the retainer includes a first plurality of magnetic elements disposed around the first cable receiving region along a first arcuate path, and the retainer includes an asymmetric guiding element;

a mating retainer having a second cable receiving region that defines a second axis, wherein the mating retainer includes a second plurality of magnetic elements disposed around the second cable receiving region along a second arcuate path that corresponds to the first arcuate path, and the mating retainer includes a complementary guiding element configured to engage the asymmetric guiding element and orient the retainer and mating retainer with the first and second axes substantially aligned; and wherein the retainer and the mating retainer are configured such that magnetic forces between respective ones of the first and second pluralities of magnetic elements tend to retain the first and second retainers proximate one another with the first and second cable receiving regions substantially aligned with one another; and wherein one of the retainer and mating retainer is configured for rotation relative to a respective one of the first and second cables, and the other one of the retainer and mating retainer is fixed relative to the respective other one of the first and second cables.

14. The connector system of claim 13, wherein the complementary guiding element is configured to engage the asymmetric guiding element and orient the retainer and mating retainer with the first and second axes substantially aligned when the retainer and mating retainer are separated by less than a predetermined distance.

15. The connector system of claim 14, wherein the asymmetric guiding element comprises an opening on the retainer that is substantially aligned with the first axis, the complementary guiding element comprises a pin disposed on the mating retainer and substantially aligned with the second axis, and the opening configured to receive the pin with a slip fit.

16. The connector system of claim 13, wherein at least some of the first and second pluralities of magnetic elements comprise permanent magnets.

17. The connector system of claim 16, wherein at least some of the first and second pluralities of magnetic elements comprise ferromagnetic material.

18. The connector system of claim 13 integrated into a cable assembly, the cable assembly comprising:

a first cable having a first end and a first electrical contact disposed proximate the first end, wherein the first end of the first cable is received within the first cable receiving region; and a second cable having a second end and a second electrical contact disposed proximate the second end, wherein the second end of the second cable is received within the second cable receiving region; and wherein the first and second electrical contacts are retained in electrical contact with each other when the magnetic forces between respective ones of the first and second pluralities of magnetic elements retain the first and second retainers proximate one another with the first and second cable receiving regions substantially aligned.

* * * * *